US010393377B2

(12) United States Patent
Holland

(10) Patent No.: US 10,393,377 B2
(45) **Date of Patent: *Aug. 27, 2019**

(54) DIRECTIONAL FIRE-STARTING SYSTEM, METHOD, AND DEVICE

(71) Applicant: Darrell Holland, Powers, OR (US)

(72) Inventor: Darrell Holland, Powers, OR (US)

( * ) Notice: Subject to any disclaimer, the term of this patent is extended or adjusted under 35 U.S.C. 154(b) by 51 days.

This patent is subject to a terminal disclaimer.

(21) Appl. No.: 15/641,473

(22) Filed: Jul. 5, 2017

(65) Prior Publication Data

US 2017/0299180 A1 Oct. 19, 2017

Related U.S. Application Data

(63) Continuation-in-part of application No. 14/176,496, filed on Feb. 10, 2014, now Pat. No. 9,732,959.

(51) Int. Cl.

| | |
|---|---|
| ***F23Q 1/02*** | (2006.01) |
| ***F23Q 1/06*** | (2006.01) |
| ***F23Q 2/22*** | (2006.01) |

(52) U.S. Cl.

CPC ..... *F23Q 1/06* (2013.01); *F23Q 2/22* (2013.01); *Y10T 29/49826* (2015.01)

(58) Field of Classification Search

None

See application file for complete search history.

(56) References Cited

U.S. PATENT DOCUMENTS

| | | | |
|---|---|---|---|
| 4,698,068 | A | 10/1987 | Jensen |
| 5,279,628 | A | 1/1994 | Hutchens et al. |
| 5,662,719 | A | 9/1997 | Dawson et al. |
| 5,919,037 | A | 7/1999 | Brillhart, III et al. |
| 8,186,995 | B2 | 5/2012 | Putrello, Jr. |
| 8,202,085 | B2 | 6/2012 | Putrello |
| 9,732,959 | B2 | 8/2017 | Holland |
| 2012/0009004 | A1 | 1/2012 | Chu |

*Primary Examiner* — Jason Lau

(74) *Attorney, Agent, or Firm* — Timothy E. Siegel Patent Law, PLLC; Timothy E. Siegel

(57) ABSTRACT

A system for starting a fire, that has a directional fire-starting device, having a front and a back, and a tube-shaped housing, defining a longitudinal dimension and further defining a slot extending longitudinally along the tube-shaped housing, the slot having a front end near to the front of the device. A flint is positioned inside the flint chamber and has a surface portion that extends adjacent to the slot. A striker has a first portion that is sized to fit through the slot and extend to the flint as a second portion extends from the slot outwardly from the tube-shaped housing, to be grasped by a user.

12 Claims, 3 Drawing Sheets

DIRECTIONAL FIRE-STARTING SYSTEM, METHOD, AND DEVICE

RELATED APPLICATIONS

This application is a continuation-in-part of U.S. application Ser. No. 14/176,496, filed Feb. 10, 2014, which is incorporated by reference as if fully set forth herein.

BACKGROUND

The present invention relates to systems, methods, and devices used to generate a spark as used, for example, in survival tools. Specifically, the present invention relates to a spark-generating device in which a strike plate is contained inside a housing for directing, focusing, and controlling the direction of the spark.

Spark-generating survival tools, also called fire-starting tools, are generally known and widely used by outdoor recreationists (back-country hikers, skiers, and campers, for example), by professional outdoorsmen (hunters, gamewardens, lumberjacks, and emergency responders, for example), and by the military. Often survival depends on the ability to generate a spark to ignite tinder that can in turn light moss, fine branches, and needles. And, frequently such devices are used in windy, wet conditions. Conditions that make traditional wax-covered (waterproof) matches ill-suited to the task at hand.

Other devices widely used to kindle fires include various types of lighters, in which a supply of fuel such as butane, alcohol or the like is stored in a reservoir within the body of the lighter. Conventional lighters, such as those described in U.S. Pat. No. 1,898,991 to Cox and U.S. Pat. No. 1,066,405 to Goldstein, operate on the principle of dispensing such supply of fuel from the body of the lighter and igniting it with a spark created by the operation of a striker against a pyrophoric element, also called a flint. Cigarette or cigar lighters therefore present the advantage of providing a flame that will typically last longer than that of a match. However, lighters have some of the same disadvantages as matches. More particularly, lighters are similarly difficult to handle in windy or rainy conditions.

In light of the many drawbacks and limitations of conventional matches and lighters, lighting kits, more suitable for lighting outdoor fires, have been developed. See for example, U.S. Pat. No. 3,402,029 to Sampson, U.S. Pat. No. 4,188,192 to Levenson and U.S. Pat. No. 4,698,068 to Jensen, which disclose various combinations of magnesium-based ignitable material with a pyrophoric element and a striker. More particularly, U.S. Pat. No. 3,402,029 discloses a method of kindling fires using a particular magnesium alloy as the igniting material. This method basically includes the steps of producing some shavings of ignitable material from a stick of Mischmetal-magnesium alloy and subsequently striking the stick itself with a hard object (the stick thereby also serving as the pyrophoric element) to create a spark to ignite the shavings. U.S. Pat. No. 4,188,192 to Levenson discloses a fire-starting apparatus comprising a body of shavable magnesium-based alloy and a separate pyrophoric element secured to the body. The apparatus accordingly provides a single composite structure serving both as the source of magnesium shavings and as the spark generating element. In both of these devices, the striker is not provided with the unit. Devices of this type generally produce the dazzling white flame and high temperatures characteristic of the instantaneous combustion of magnesium.

U.S. Pat. No. 4,698,068 to Jensen discloses a fire-igniting device having a case adapted to receive a rod of shavable magnesium and a small pyrophoric element secured to the rod. A striker, attached to the outside of the case, is also provided to scrape shavings of magnesium and to create a spark when the striker is brought into contact with the pyrophoric element. Fire starting tools according to the Jensen patent, although more practical and effective than those disclosed in earlier patents, have several limitations. First, the user must produce shavings of flammable material as a step of the fire-starting process. Second, it is desirable for the tool to be suited for repeated use. Therefore, the rod of the fire-starting tool must be large enough to provide a sufficient quantity of flammable material to light more than one fire. However, although the pyrophoric element secured to the rod must be of sufficient size for ease of operation with the striker, such pyrophoric element must be small enough so as to not reduce appreciably the amount of magnesium available to create shavings necessary to light several fires. Finally, the magnesium combustion generates intense heat during a very brief moment (typically under half a minute), rendering fire lighting generally dangerous and particularly difficult under rainy or cold conditions.

Yet other devices include a weatherproof housing containing a strike plate and a striker (see, for example, U.S. Pat. No. 5,279,628 issued on 1994 Jan. 18 to Hutchens et al.) Hutchens et al. instruct a fire-starting kit having an ignition device, a supply of combustible tinder material, and a hollow case in which the ignition device and tinder are stored.

However, all the above fire-starting devices have failed to address directing spark in windy conditions. So, an improved fire-starting device should not only be usable in wet or windy conditions for an extended period of time, and be more durable than those using shavable, ignitable material to allow for numerous fire starting, and it should be more convenient and safer to use than presently known prior art devices, it should also provide means for directing the spark toward the tinder in windy, wet conditions.

SUMMARY OF THE INVENTION

The present invention overcomes problems with known fire-starting devices taught in the current art.

In one preferred embodiment, the present invention includes a device termed a "Spark Concentration Sleeve," which directs all of the spark generated from a ferrocerium rod (or any other spark-producing or flint-like material, as would be well-understood by those skilled in the art) directly to a tinder creating an instant fire and is particularly well suited for survival applications. Conventional fire-starters disperse sparks in every direction and this is exasperated by windy conditions that may prevent a fire from starting at all. In contrast, the present invention directs the sparks toward the tinder making it more robust and can start a fire even in windy conditions due to the spark concentration.

Additionally, the housing includes a slot, termed a "striker guide", which directs the striker against the ferrocerium rod for robust contact. In contrast, in conventional flint and striker systems, the forward force used to generate a spark is uncontrollable and the striking action often scatters the tinder when the striker glances off the ferrocerium rod at the end of the stroke resulting in wasted tinder and a spark that does not catch. The present invention overcomes and eliminates this from occurring by a stop feature at the end of the slot and no longer is the tinder scattered over the fire-site by the striker as occurs in conventional designs.

Further, in one embodiment, an integral tinder storage container allows the user to have tinder available when needed and is integral to the fire-starter device. Hunters, fishermen, hikers, pilots, military units, and survivalists may not have the luxury of finding or having available dry tinder by which to start a fire.

In this embodiment, a protective cap allows easy removal of the tinder material and features a friction fit, and avoids a conventional screw cap, which is hard to remove with cold hands.

Finally, in one embodiment, the device includes a ferrocerium rod, which is selectively coupled and therefore removable from the machined housing with a single setscrew and can be replaced as they wear or are used to their entirety.

DRAWINGS

DESCRIPTION OF THE PREFERRED EMBODIMENTS

Possible embodiments will now be described with reference to the drawings and those skilled in the art will understand that alternative configurations and combinations of components may be substituted without subtracting from the invention. Also, in some figures certain components are omitted to more clearly illustrate the invention.

Figure 1:
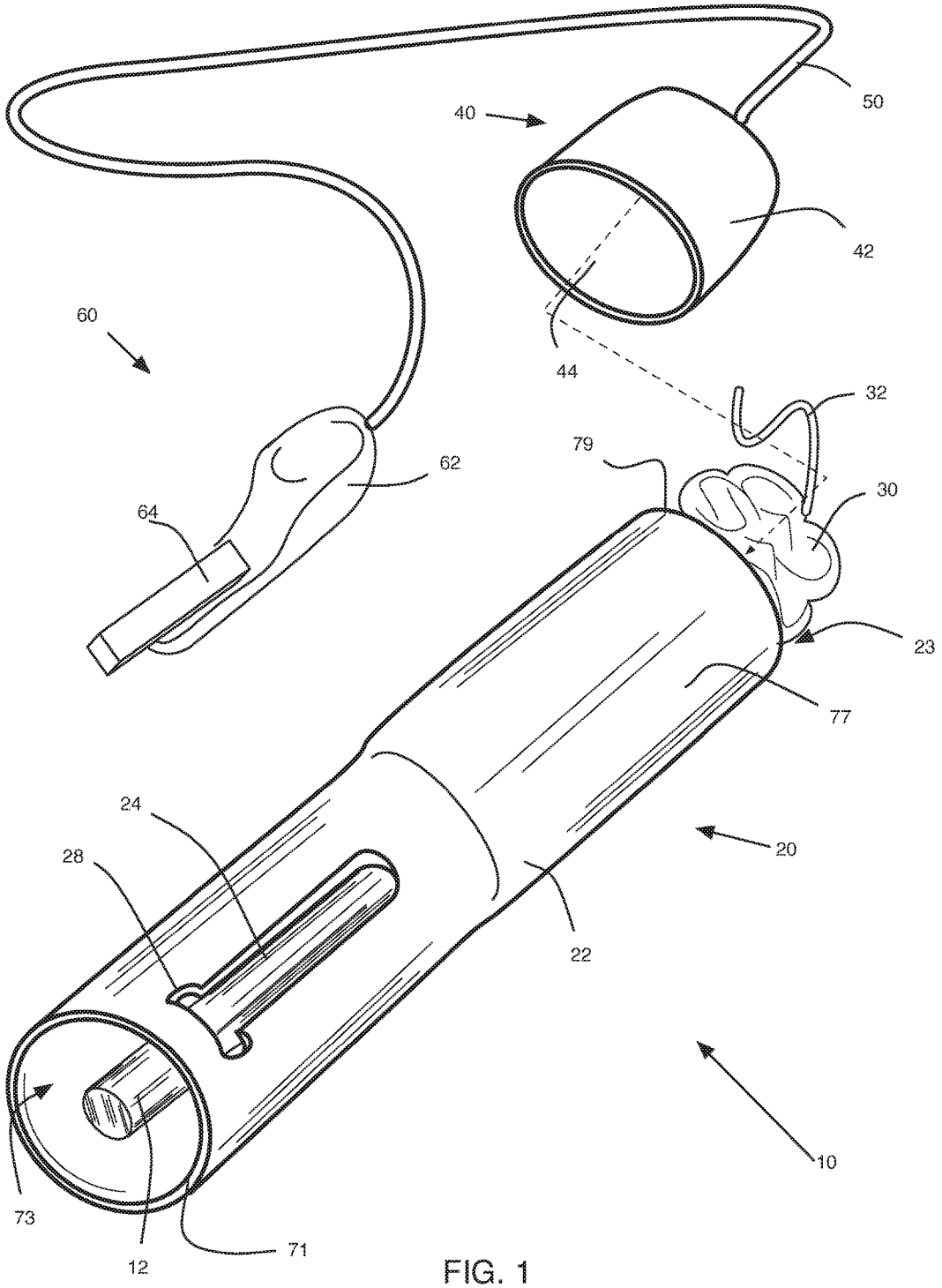
FIG. 1 is an offset frontal view of a preferred embodiment of the present invention wherein the device is shown with certain components removed.
Figure 2:
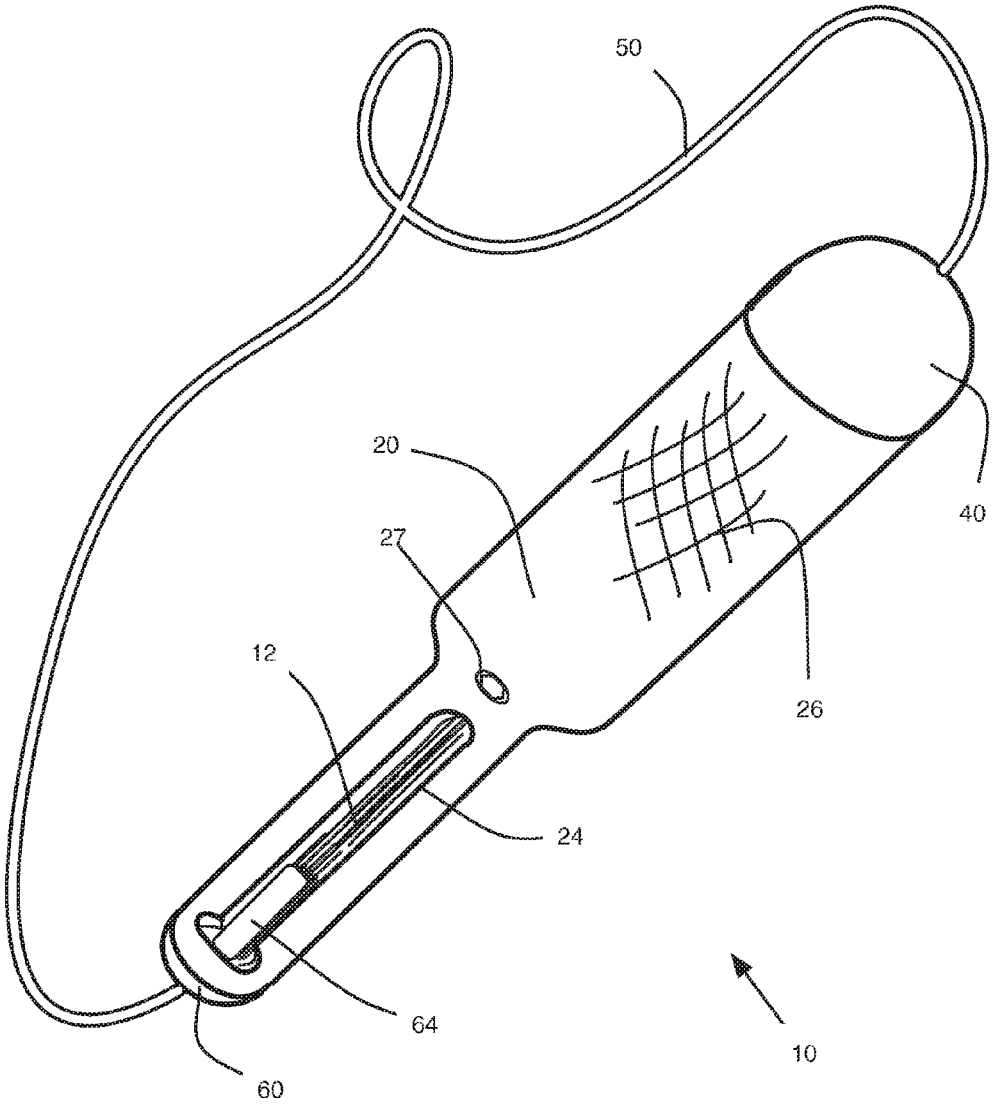
FIG. 2 is an offset frontal view of the embodiment of FIG. 1, however the device is shown in the closed, compact position.
Figure 3:
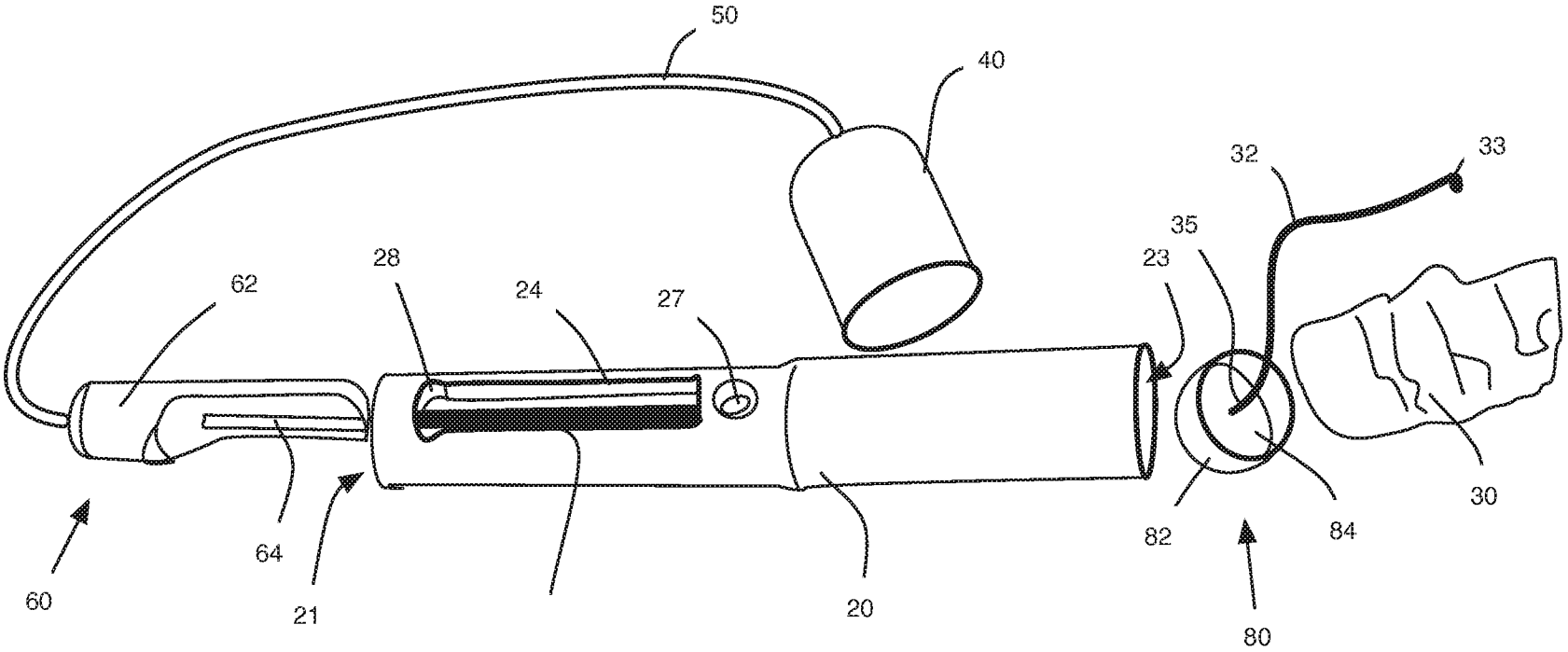
FIG. 3 is an offset side view of the embodiment of FIG. 1, showing additional components in an exploded assembly view of the device.

FIGS. 1-3 best illustrate a first preferred embodiment of the present invention. In FIG. 1, a fire-starting device 10 is shown in an open or expanded view of the components whereas FIG. 2 shows this same device 10 in a closed position. In this first preferred embodiment, the fire-starting device 10 includes a cylindrical housing 20. However, those skilled in the art would appreciate that many other shapes, sizes, and configurations would work equally well. In this preferred embodiment, the housing is fabricated from aluminum, however, other materials would work as well and therefore it is contemplated that the housing could be made from metals and their alloys including aluminum, brass, and stainless steel, for example, or from various composite materials including plastic, ABS, glass-filled nylon, and fiberglass, for example. The exterior and or interior may be finished by a secondary process including anodizing, rubberizing, powder-coating, plating, or painting, for example.

An endcap 40 slip fits over the second open end and is made from plastic, aluminum, steel, or rubber or other composite or similar material. Ideally the cap 40 slips over, but other configurations are contemplated including the use of an internal O-ring sealing member and using a threaded interface. The cap could also be hinged to the second end or have cooperating a screw-threads.

However, in the preferred embodiment, as FIGS. 1-3 show, the present invention contemplates a fire-starting device 10 having an elongated cylindrical body that has two, axially aligned chambers. A first chamber 21 arranges adjacent to a first open end and is adapted to receive a ferrocerium rod 12, which can attach to an interior feature (not shown in the drawings) by means of a fastener, such as a single setscrew 27. Thus, when the strike rod 12 wears out, or is damaged, a new, replacement rod can easily be attached to the device. This first chamber (also referred to as a flint chamber 73) containing the rod 12 has a single sidewall (appearing as an ellipse or circle from its end view). A portion of the sidewall 22 exposes the first chamber so that the rod 12 can be seen through the slot 24. This slot, along with a stop feature 28, enables a striker 60 to contact the rod to generate a spark, and this use will be further described below.

Returning again to the description of the housing, the housing also includes a handle end 77 having an open second end 79. This second end configures to define a second chamber 23 (also referred to as the tinder chamber 23), which itself is configured to receive a replaceable amount of tinder material 30. A cord 32 attaches to a plug 80 that is inserted into the second chamber and the tinder material is stacked on top of the plug so to aid in extraction of the tinder material when placed in the second chamber 23. This second end, or handle portion 77, of the housing further may include a grip-enhancing surface feature 26 such as machined grooves to increase frictional contact with a user's hand or gloved-hand. Of course, other friction-enhancing surface features could be incorporated including coatings such as rubber or rubber-like material and the like, as would be well-appreciated by those skilled in this art.

At the second end, an endcap 40 fits over at least a portion of the housing 20 by means of a friction or interference fit. The endcap 40 has an open end 44 and a circular sidewall 42.

At the first end 71 of the housing 20, a striker assembly 60 adapts to slideably insert into the first end. The striker 60 is removable from the open end 71. The striker 60 includes a gripping end 62 and a striker bar 64. The striker bar couples to the grip end by being molded or cast together making a solid integral unit. The striker bar is made from high-speed steel. Alternatively, the striker bar may be selectively removable and attachable to the gripping end by means of one or more fasteners to facilitate replacement or repair of the striker.

A shock cord 50 (or other similar tether) connects to the striker assembly 60 and to the cap 40 and serves as a retention device so that when either the cap or the striker is removed from the housing, the cap or striker is still retained in proximity to the housing.

The plug 80, as FIG. 3 shows, is sized to fit inside the second chamber 23 and includes an open-ended cup-like chamber 84 defined by a circular sidewall 82 with a flat closed end 35. At one end, a cord 32 attaches to the flat closed end while the cord's second end may include a knot 33 to help the user grab hold of the cord when wanting to extract the tinder material. To insert the tinder material into the second chamber 23, a portion of the tinder material 30 is compacted the cup and the cord extends the length of the second chamber. Then the plug and tinder material are pushed into the second chamber.

To use the device 10 to generate a spark, a user opens the endcap 40 from the second end of the housing 20 and removes a small piece of the tinder material 30 and places a portion of the tinder material adjacent to flammable material such as branches, twigs and the like. The cap is replaced on the second end. Next, the striker 60 is removed from the first end 71 of the housing. The striker bar 64 is placed in the slot 24 toward the center of the housing. The fire-starter device 10 is held at or about 45-degree downward angle toward the tinder material. The striker bar is then moved rapidly inside the slot from the center of the housing toward the first end, while remaining in the slot 24 and rubbing against the rod 12. The open first end 71 is directed toward the tinder material. The rapid motion of the striker bar 64 on the rod 12 generates a series of sparks. The shape of the housing's first chamber directs the spark downward toward the open end. When the striker bar reaches the stop feature 28, the striker bar is removed from the slot. While this is happening, sparks are emitted from the first open end and making contact with the tinder material, which ignites.

In alternative contemplated and preferred embodiments, the fire-starting device 10 can be incorporated into other tools. For example, the housing 20 can be configured in a body having any at least one of the following additional tools—a fixed-blade knife, a pivoting blade-knife, a compass, a mirror, a combination multi-tool, or a sidearm.

Although the invention has been particularly shown and described with reference to certain embodiments, it will be understood by those skilled in the art that various changes in form and detail may be made without departing from the spirit and scope of the invention.

The invention claimed is:

1. A directional fire-starting device, having a front and a back, comprising:

a. a tube-shaped housing, defining a longitudinal dimension and further defining a slot extending longitudinally along the tube-shaped housing, the slot having a front end positioned near the front of the device, the tube-shaped housing further defining a flint chamber, having an open end at the front of the device;

b. a flint positioned inside the flint chamber, and separated by void space from the tube-shaped housing, and having a surface portion that extends adjacent to, and is thereby transversely accessible through, substantially the entirety of the slot; and c. a striker having a first portion and a second portion, and wherein the first portion is sized to fit through the slot and extend to the flint as the second portion extends from the slot outwardly from the tube-shaped housing;

d. whereby a user may hold the striker by the second portion, extend the first portion through the slot at the back of the slot, and push the striker against the flint material as the striker is rapidly moved from the back to the front of the slot, thereby causing sparks to fly out of the flint chamber open end at the front of the device.

2. The directional fire-starting device of claim 1, wherein the striker first portion is made of metal and the striker second portion is a handle, made in part of a second material, distinct from the metal of the first portion, and joined to the metal of the first portion.

3. The directional fire-starting device of claim 2, wherein the striker is shaped to fit onto the open end of the flint chamber, with the striker extending into the flint chamber and the handle snugly fitting at the open end of the flint chamber, so that a portion of the handle extends outside of the chamber, thereby being accessible to a user and is also removable from the open end of the flint chamber, by pulling the handle outwardly from the open end of the flint chamber.

4. The directional fire-starting device of claim 1 wherein the flint is selectively removable from the directional fire-starting device.

5. The directional fire-starting device of claim 1, wherein the flint is in the shape of a round rod.

6. The directional fire-starting device of claim 1, wherein the flint is made of ferrocerium.

7. The directional fire-starting device of claim 1, wherein the tube-shaped housing is round in transverse dimension.

8. The directional fire-starting device of claim 1, wherein the tube-shaped housing, further includes a transverse wall defining a back to the flint chamber and further defining a tinder chamber, defined by the transverse wall and the tube-shaped housing, to the back of the flint chamber.

9. The directional fire-starting device of claim 1, wherein the device further includes a handle to the rear of the flint chamber, to permit a user to grasp the device at a position rearward of the slot, as the device is used to start a fire.

10. A method of starting a fire, comprising:

a. providing a directional fire-starting device, comprising:

(i) a tube-shaped housing, defining a longitudinal dimension and further defining a slot extending longitudinally along the tube-shaped housing, the slot having a front end positioned near the front of the device, the tube-shaped housing further defining a flint chamber, having an open end at the front of the device;

(ii) a flint positioned inside the flint chamber, and separated by void space from the tube-shaped housing, and having a surface portion that extends adjacent to, and is thereby transversely accessible through, substantially the entirety of the slot; and (iii) a striker;

b. providing a combustible tinder material;

c. holding the striker and extending a portion of the striker through the slot, at the back of the slot;

e. pushing the striker against the flint and moving the striker rapidly from the back to the front of the slot to generate sparks from the flint chamber open end at the front of the device; and g. directing the sparks from the flint chamber open end towards the combustible tinder material, thereby starting a fire from the contact between the sparks and the combustible tinder material.

11. The method of claim 10, wherein the directional fire-starting device in an initial state has the striker held in the open end of the flint chamber, and further including the step of pulling the striker out of the open end of the flint chamber, prior to extending a portion of the striker through the slot.

12. The method of claim 10, wherein the striker includes a handle and a portion sized to extend through the slot.

* * * * *